US012566035B2

(12) United States Patent
Mohanta et al.

(10) Patent No.: US 12,566,035 B2
(45) Date of Patent: Mar. 3, 2026

(54) SIMPLE DISTRIBUTOR FOR INLET MANIFOLD OF MICROCHANNEL HEAT EXCHANGER

(71) Applicant: Carrier Corporation, Palm Beach Gardens, FL (US)

(72) Inventors: Lokanath Mohanta, Liverpool, NY (US); Arindom Joardar, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 112 days.

(21) Appl. No.: 18/389,675

(22) Filed: Dec. 19, 2023

(65) Prior Publication Data

US 2024/0210128 A1 Jun. 27, 2024

Related U.S. Application Data

(60) Provisional application No. 63/477,114, filed on Dec. 23, 2022.

(51) Int. Cl.
*F28F 9/02* (2006.01)

(52) U.S. Cl.
CPC ..... *F28F 9/026* (2013.01)

(58) Field of Classification Search
CPC ..... F28F 9/0265; F28F 9/027
See application file for complete search history.

(56) References Cited

U.S. PATENT DOCUMENTS 5,094,293 A * 3/1992 Shinmura ..... F28D 1/05366 228/183
5,415,223 A 5/1995 Reavis et al.
5,479,784 A 1/1996 Dobmeier et al.
5,806,586 A 9/1998 Osthues et al.
5,901,785 A * 5/1999 Chiba ..... F28F 9/027 165/DIG. 465

(Continued)

FOREIGN PATENT DOCUMENTS

CN 107543336 A 1/2018
CN 215984075 U 3/2022

(Continued)

OTHER PUBLICATIONS

Extended European Search Report received for EP Application No. 23218306.1, dated Jun. 14, 2024, 6 Pages.

*Primary Examiner* — Devon Lane
(74) *Attorney, Agent, or Firm* — Souad Hakim

(57) ABSTRACT

A distributor for an inlet manifold of a microchannel heat exchanger is disclosed. The distributor comprising a nozzle adapted to the fluidically connected to a supply tube of a refrigeration line of the heat exchanger, wherein the supply tube is at least partially disposed within an inlet manifold of the heat exchanger. The nozzle comprises a first hollow portion having a round cross-section and adapted to be fluidically connected to the supply tube, and a second hollow portion having an oval or elliptical cross-section, wherein the second portion is fluidically connected to the first portion such that the nozzle gradually transitions from the first portion to the second portion and flow area of the nozzle reduces in a direction from the first portion to the second portion.

19 Claims, 4 Drawing Sheets

(56) References Cited

U.S. PATENT DOCUMENTS

| | | | | |
|---|---|---|---|---|
| 6,129,144 | A * | 10/2000 | Bousquet | F28F 9/027 165/DIG. 466 |
| 6,145,587 | A * | 11/2000 | Hanafusa | F28D 1/0341 165/174 |
| 6,199,401 | B1 | 3/2001 | Haussmann | |
| 6,363,965 | B1 | 4/2002 | Carmack | |
| 6,585,038 | B2 * | 7/2003 | Bousquet | F28F 9/0246 165/176 |
| 7,895,860 | B2 | 3/2011 | Tucker et al. | |
| 7,921,558 | B2 | 4/2011 | Beamer et al. | |
| 7,967,060 | B2 | 6/2011 | Trumbower et al. | |
| 7,967,061 | B2 | 6/2011 | Gorbounov et al. | |
| 8,113,270 | B2 | 2/2012 | Rios et al. | |
| 9,423,190 | B2 * | 8/2016 | Huazhao | F28F 9/0273 |
| 2004/0182554 | A1 * | 9/2004 | Bousquet | F28D 1/0341 165/176 |
| 2004/0244957 | A1 * | 12/2004 | Takahashi | F28D 1/05391 165/173 |
| 2010/0242535 | A1 | 9/2010 | Jianlong et al. | |
| 2013/0192808 | A1 | 8/2013 | Liu | |
| 2022/0042745 | A1 * | 2/2022 | Hirokawa | B23K 1/0012 |
| 2024/0159479 | A1 * | 5/2024 | Adachi | F28F 9/026 |

FOREIGN PATENT DOCUMENTS

| | | | |
|---|---|---|---|
| JP | H07301472 | A | 11/1995 |
| JP | 3007839 | B2 | 2/2000 |

* cited by examiner

SIMPLE DISTRIBUTOR FOR INLET MANIFOLD OF MICROCHANNEL HEAT EXCHANGER

CROSS-REFERENCE TO RELATED APPLICATION

This patent application claims the benefit of U.S. Provisional Patent Application No. 63/477,114, filed on Dec. 23, 2022, which is incorporated by reference herein in its entirety.

TECHNICAL FIELD

This invention relates to the field of heat exchangers, and more particularly, a simple and improved distributor for the inlet manifold of heat exchangers.

BACKGROUND

The distribution of fluid among multiple microchannel tubes of a heat exchanger plays a significant role in the overall performance of the heat exchanger and effective utilization of the heat transfer surface. There is, therefore, a need to provide a simple and efficient distributor for the inlet manifold of heat exchangers.

SUMMARY

Described herein is a distributor for an inlet manifold of a microchannel heat exchanger. The distributor comprises a nozzle adapted to be fluidically connected to a supply tube of a refrigeration line of the heat exchanger, wherein the supply tube is at least partially disposed within an inlet manifold of the heat exchanger. The nozzle, having a flow area, comprises a first hollow portion having a round cross-section and adapted to be fluidically connected to the supply tube, and a second hollow portion having an oval or elliptical cross-section, wherein the second portion is fluidically connected to the first portion such that the nozzle gradually transitions from the first portion to the second portion and the flow area of the nozzle reduces in a direction from the first portion to the second portion.

In one or more embodiments, a first end of the nozzle comprises a first opening that is connected to the supply tube and a second end of the nozzle comprises a second opening opposite to the first opening.

In one or more embodiments, the second opening has one or more of a race-track profile, a rectangular profile, a circular profile, and an oval profile.

In one or more embodiments, the nozzle is disposed within the inlet manifold such that the second end or second opening of the nozzle remains at least partially before one or more microchannel tubes associated with the inlet manifold.

In one or more embodiments, the nozzle is at a predefined height above ports associated with one or more microchannel tubes associated with the inlet manifold.

In one or more embodiments, the first portion of the nozzle has a predefined inner diameter equal to an inner diameter of the supply tube, and wherein the second portion has a predefined height less than the inner diameter of the first portion and a predefined width greater than the inner diameter of the first portion.

In one or more embodiments, the second portion has a predefined width to height ratio ranging from 40 to 1/40.

In one or more embodiments, the second portion is oriented at a predefined angle within respect to a horizontal plane of the inlet manifold.

In one or more embodiments, the second portion is oriented horizontally within the inlet manifold.

In one or more embodiments, the flow area of the nozzle from the first portion to the second portion is reduced in a range of 20-70%.

Also described herein is a heat exchanger comprising an inlet manifold fluidically connected to an outlet manifold via a plurality of microchannel tubes, a supply tube associated with a refrigeration line at least partially disposed within the inlet manifold, and a nozzle fluidically connected to the supply tube within the inlet manifold. The nozzle, having a flow area, comprises a first hollow portion having a round cross-section and adapted to be fluidically connected to the supply tube, and a second hollow portion having an oval or elliptical cross-section, wherein the second portion is fluidically connected to the first portion such that the nozzle gradually transitions from the first portion to the second portion and the flow area of the nozzle reduces in a direction from the first portion to the second portion.

In one or more embodiments, a first end of the nozzle comprises a first opening that is connected to the supply tube and a second end of the nozzle comprises a second opening opposite to the first opening.

In one or more embodiments, the second opening has one or more of a race-track profile, a rectangular profile, a circular profile, and an oval profile.

In one or more embodiments, the nozzle is disposed within the inlet manifold such that the second opening of the nozzle remains at least partially before the microchannel tubes within the inlet manifold.

In one or more embodiments, the nozzle is at a predefined height above ports associated with the microchannel tubes within the inlet manifold.

In one or more embodiments, the first portion of the nozzle has a predefined inner diameter equal to an inner diameter of the supply tube, and wherein the second portion has a predefined height less than the inner diameter of the first portion and a predefined width greater than the inner diameter of the first portion.

In one or more embodiments, the second portion has a predefined width to height ratio ranging from 40 to 1/40.

In one or more embodiments, the second portion is oriented at a predefined angle within respect to a horizontal plane of the inlet manifold.

In one or more embodiments, the flow area of the nozzle from the first portion to the second portion is reduced in a range of 20-70%.

In one or more embodiments, the supply tube is disposed of at one end of the inlet manifold, and wherein the supply tube is configured to supply a fluid from the refrigeration line within the inlet manifold via the nozzle to enable uniform distribution of the fluid across ports of each of the multichannel tubes within the inlet manifold.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
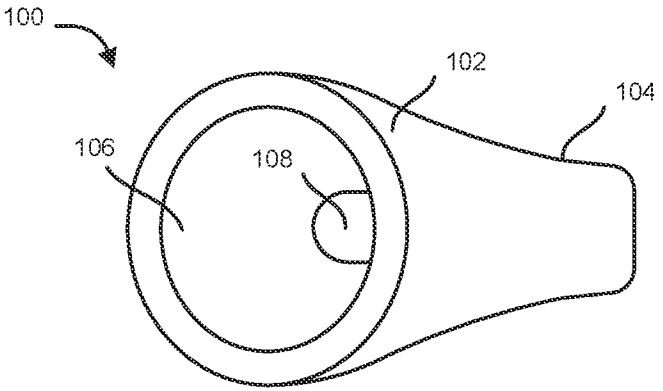
FIGS. 1A to 1D illustrate exemplary views of a nozzle/distributor for an inlet manifold of a heat exchanger in accordance with one or more embodiments of the disclosure.
Figure 1B:
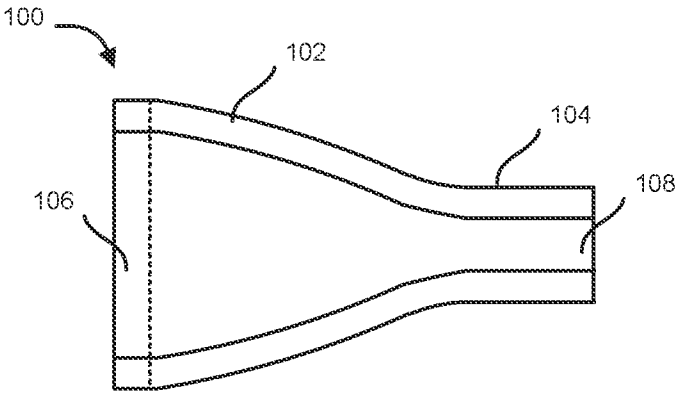
Figure 1C:
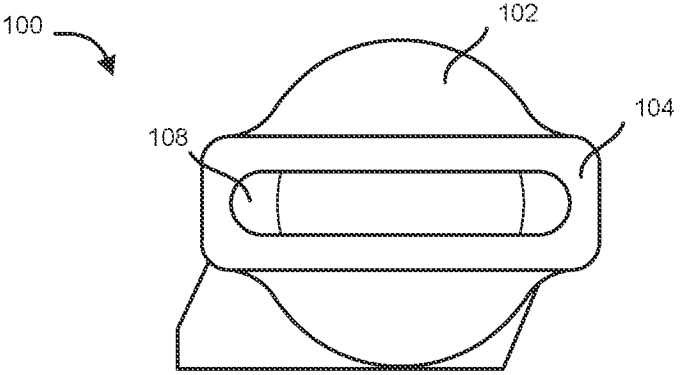
Figure 1D:
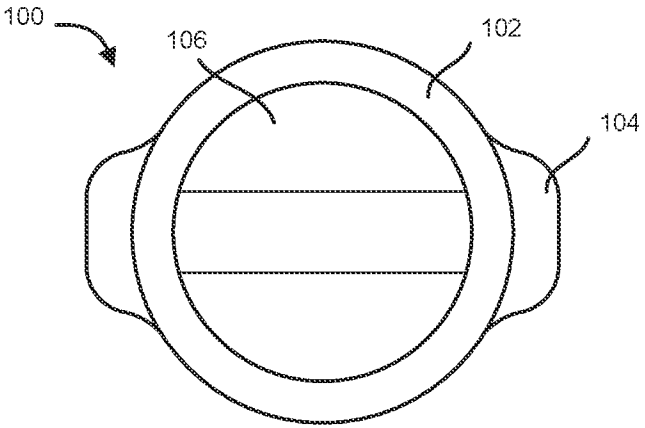

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the nozzle, multichannel tube, manifold, heat exchanger, and corresponding components, described herein may be oriented in any desired direction.

Microchannel heat exchangers ("heat exchangers") typically include multiple microchannel tubes having multiple inlet ports, which connect and extend from an inlet manifold to an outlet manifold of the heat exchanger. The distribution of fluid among the multiple microchannel tubes plays a significant role in the overall performance of the heat exchanger and effective utilization of the heat transfer surface. This is also applicable to other categories of heat exchangers such as brazed plate heat exchangers, round tube plate fin heat exchangers, and the like. This distributor and heat exchanger described herein provide a simple and efficient distributor for the inlet manifold of heat exchangers, which enables even distribution of fluid or refrigerant across ports of the tubes within the inlet manifold of the heat exchanger with minimal pressure drop.

Referring to FIG. 1A to 1F, the distributor 100 for an inlet manifold of a microchannel heat exchanger "heat exchanger" is disclosed. The distributor 100 is designed as a nozzle 100 that is adapted to be fluidically connected to a supply tube 110 of a refrigeration line of the heat exchanger, where the supply tube 110 is disposed within the inlet manifold through one of the ends of the inlet manifold. In some embodiments, the nozzle 100 may be removably fitted to an outlet of the supply tube 110 within the inlet manifold, however, the nozzle 100 may also be an integral part of the supply tube 110.

As illustrated in FIGS. 1A to 1D, the nozzle 100 includes a first hollow portion 102 having a round cross-section that is adapted to be fluidically connected to the supply tube 110. The nozzle 100 further includes a second hollow portion 104 having an oval or elliptical cross-section, that is fluidically connected to the first portion 102 such that the nozzle 100 gradually transitions from the first portion 102 to the second portion 104 and the flow area of the nozzle reduces in a direction from the first portion 102 to the second portion 104. The first portion 102 of the nozzle 100 has a predefined inner diameter equal to the inner diameter of the supply tube 110. The second portion 104 has a predefined height less than the inner diameter of the first portion 102 and a predefined width greater than the inner diameter of the first portion 102, thereby forming the oval or elliptical section. In an embodiment, the second portion 104 has a predefined width to height ratio ranging from 40 to 1/40, such that the flow area of the nozzle from the first portion 102 to the second portion 104 is reduced in a range of 20-70%. For instance, the width to height ratio of '40' corresponds to a flat second portion 104 in a horizontal orientation forming a wide nozzle. Further, the width to height ratio of '1' corresponds to a circular nozzle. Furthermore, the width to height ratio of '1/40' corresponds to a flat nozzle in vertical orientation. In addition, the major axis of the oval opening can be aligned to any other orientation in between horizontal and vertical axis.

Figure 2:
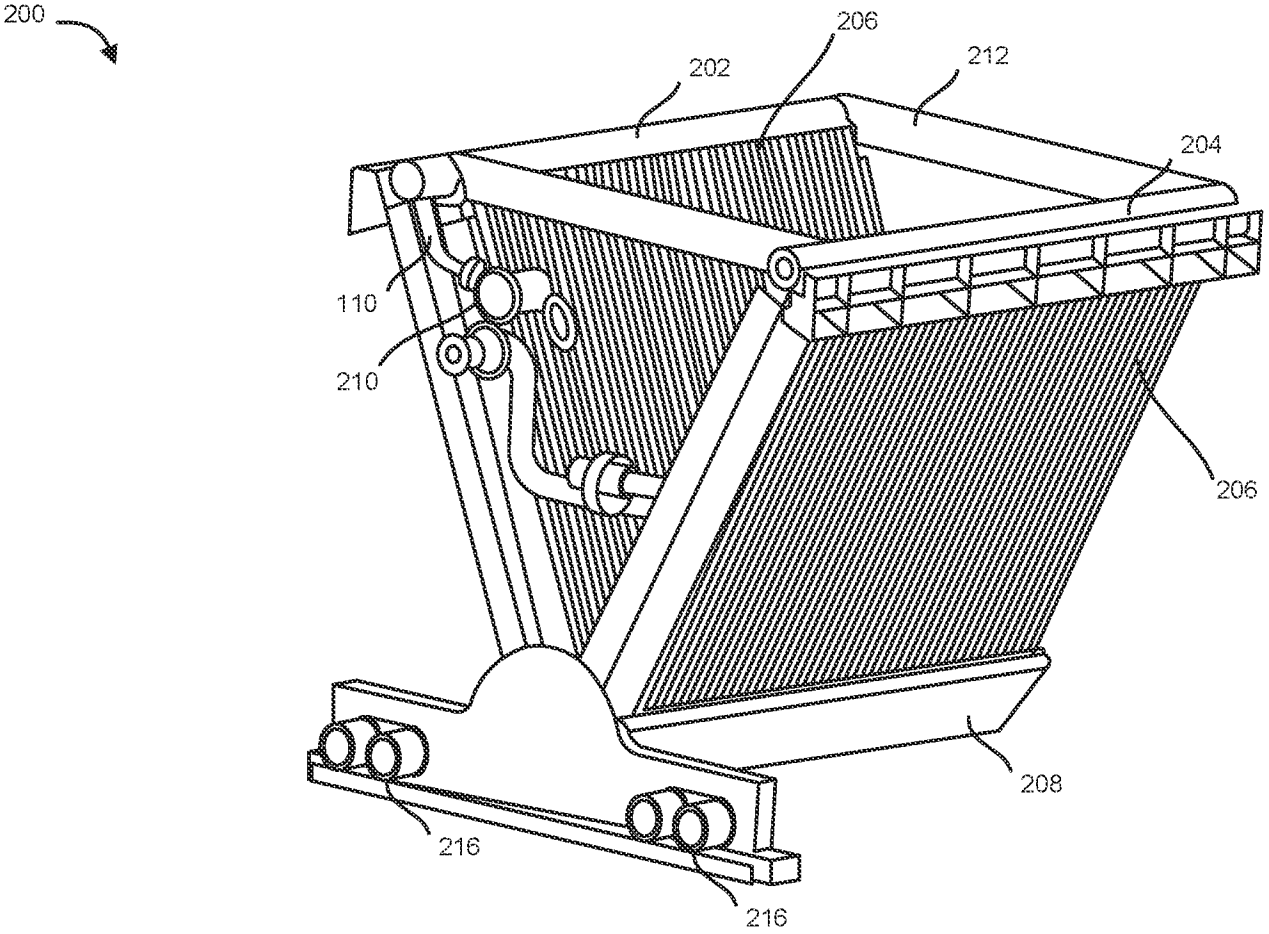
FIG. 2 is a schematic diagram illustrating an isometric view of a heat exchanger having a downward fluid flow configuration in accordance with one or more embodiments of the disclosure.

Further, the second portion 104 of the nozzle 100 is oriented at a predefined angle with respect to a horizontal plane of the inlet manifold. In an exemplary embodiment, as shown in FIG. 2, the second portion (flat portion) 104 of the nozzle 100 can be oriented horizontally within the inlet manifold 202, however, the second portion (flat portion) 104 of the nozzle can also be oriented vertically or at another angle within the inlet manifold 202 based on design and orientation of the inlet manifold 202, and all such embodiments are well within the scope of this invention.

Figure 3:
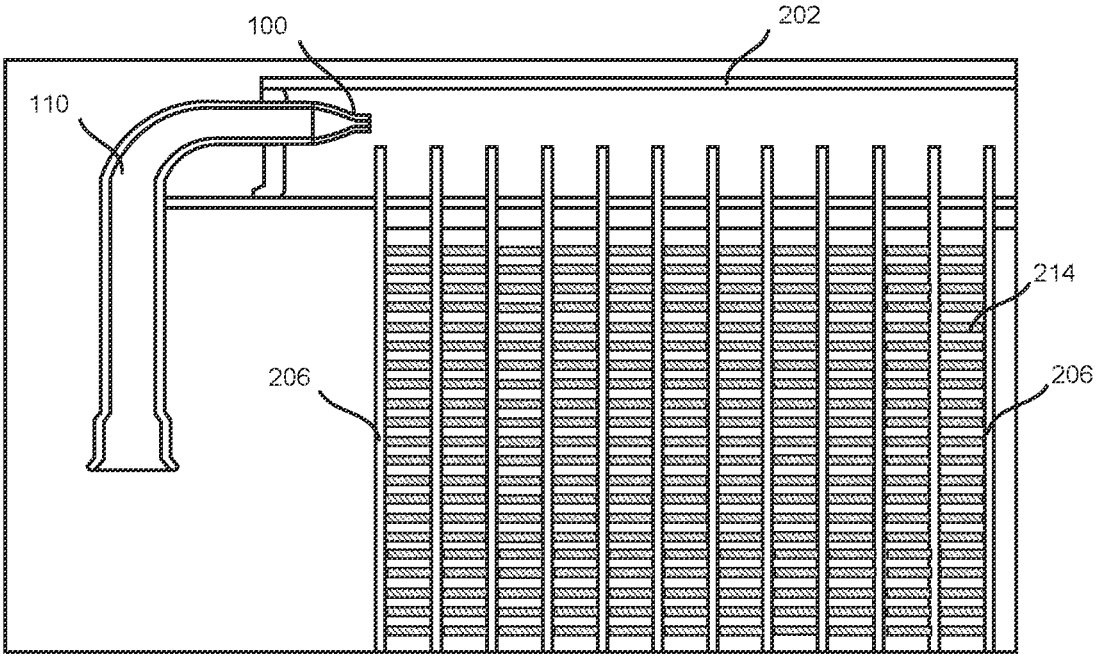
FIG. 3 is an enlarged inner view of FIG. 2 depicting the nozzle disposed within the inlet manifold of the heat exchanger of FIG. 2 in accordance with one or more embodiments of the disclosure.

A first end of the nozzle (first portion 102) includes a first opening 106 that is connected to the supply tube 110 and a second end of the nozzle (second portion 104) includes a second opening 108 opposite to the first opening 106. The first opening 106 has a circular profile having a predefined inner diameter equal to the inner diameter of the supply tube 110. Further, the second opening 108 has one or more of a race-track profile (e.g., elliptical), a rectangular profile, a circular profile, and an oval profile, but not limited to the like. In one or more embodiments, the nozzle 100 is fitted with the supply tube 110 and is disposed within the inlet manifold 202 such that the second end or second opening 108 of the nozzle 100 remains before or in line with a first tube among the plurality of tubes 206 and the nozzle 100 remains at a predefined height above the first end (top end) of the tubes 206 of the heat exchanger 200 as shown in FIG. 3. For instance, if the first tube is considered to be an origin along a longitudinal axis of the manifold 202, the second opening 108 of the nozzle 100 may remain at the origin or zero millimeters from the first tube. Further, the second opening 108 of the nozzle 100 may also be located at a desired distance before the first tube i.e., in a negative location from the first tube (origin) along the longitudinal axis of the manifold 202.

In some embodiments, the nozzle 100 is fitted with the supply tube 110 and is disposed within the inlet manifold 202 such that the second end or second opening 108 of the nozzle 100 can be located anywhere between two ends of the manifold 202 and at a predefined height above the top end of the tubes 206 of the heat exchanger 200. In such instance, the second opening 108 of the nozzle 100 may also be located after the first tube i.e., in a positive location from the first tube or origin along the longitudinal axis of the manifold 202.

In one or more embodiments, the length of the nozzle 100 can be 0.3 to 2 times the diameter of the inlet manifold 202. As the flow area of the nozzle 100 reduces in a direction from the first portion 102 to the second portion 104 of the nozzle 100, the velocity of a fluid (refrigerant) increases while flowing through the nozzle 100, which helps in breaking the fluid into droplets much earlier, leading to homogeneous two-phase flow. In addition, the flat profile and horizontal orientation of the second portion 104 of the nozzle 100 generates a wider jet of the fluid within the inlet manifold 202 which nearly covers the entire diameter of the inlet manifold 202, thereby enhancing port to port distribution in the tubes 206 with minimal pressure drop.

Figure 1E:
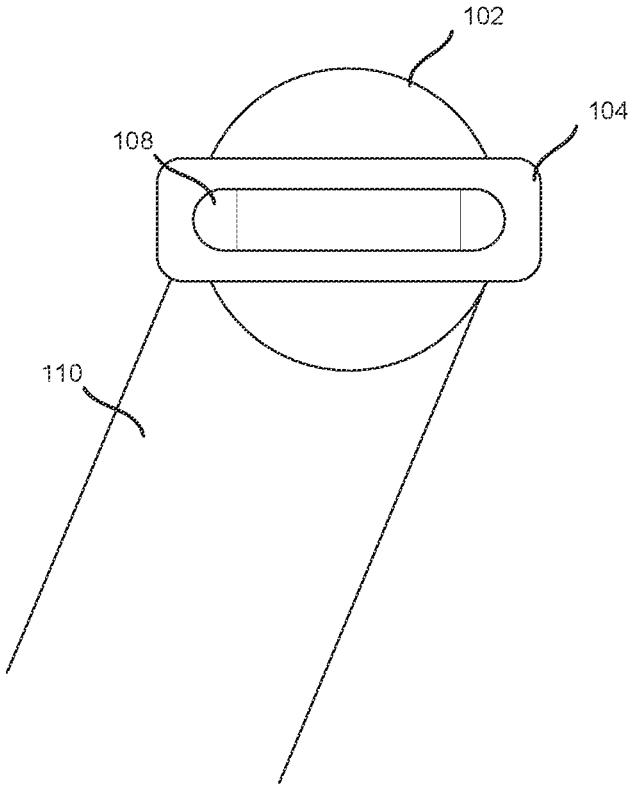
FIGS. 1E and 1F illustrate exemplary views of the nozzle/distributor fitted at an outlet of a supply tube of the heat exchanger in accordance with one or more embodiments of the disclosure.
Figure 1F:
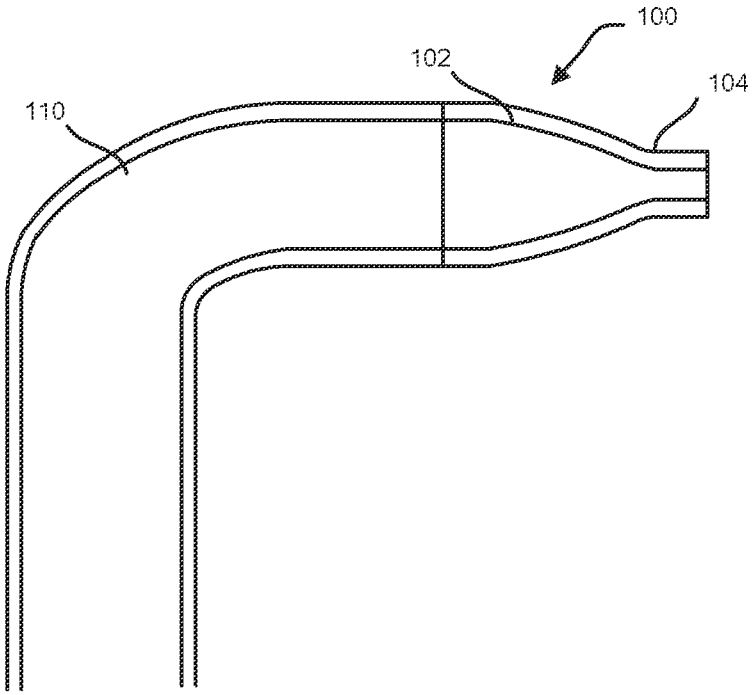

In an embodiment, as shown in FIGS. 1E and 1F, the supply tube 110 may have an L-shaped profile with a first section extending upward within the inlet manifold from the bottom of the inlet manifold and a second section extending perpendicular to the first section with a curved section between the first section and the second section such that the second section of the supply tube 110 remains parallel to a longitudinal axis of the inlet manifold 202. However, in other embodiments (not shown), the supply tube 110 may be directly disposed within the inlet manifold 202 through a flat base at one of the ends of the inlet manifold 202 such that the supply tube remains parallel to a longitudinal axis of the inlet manifold 202. Further, the nozzle 100 is fitted at the outlet of the second section of the supply tube 110 such that the vapor ejected by the nozzle 100 within the inlet manifold 202 nearly covers the entire diameter and length of the inlet manifold 202.

Referring to FIGS. 2 and 3, an exemplary embodiment of the heat exchanger 200 of this invention having a downward fluid flow configuration is illustrated. The heat exchanger 200 includes an inlet manifold 202 (also known as inlet header) and an outlet manifold 204 (also known as outlet header), which may preferably be configured horizontally over a support structure 212 at the same elevation, however, in other embodiments, the inlet manifold 202 may also be positioned at an elevated height above the outlet manifold 204. Further, the heat exchanger 200 includes a plurality of multichannel tubes 206 (tubes 206) in fluidic communication with the inlet manifold 202 and the outlet manifold 204. The tubes 206 are equally spaced and extend parallelly, with one end (first end) of the tube 206 disposed within the inlet manifold 202 and the other end extending out of the inlet manifold 202 at a predefined angle and further connected to and disposed within the outlet manifold 204, however, the tubes 206 can also extend vertically downward from the inlet manifold 202 to enable flow of the fluid in the vertically downward direction. Further, in other embodiments (not shown in FIG. 2), the tubes 206 can also extend vertically upward or at an angle to a vertical axis from the inlet manifold 202 to enable flow of the fluid in the vertically upward direction.

The tube 206 includes a hollow member which may preferably have a flat profile having opposite flat walls, however, the tube 206 may also have other profiles without any limitations and all such embodiments are well within the scope of this invention. Further, tube 206 includes multiple channels configured along an axis of the tube therewithin and extending parallelly between a first end (top end) and a second end (bottom end) of the hollow member such that multiple fluid flow paths of a predefined radius (for example, generally in the range of millimeters) are created between the first end and second end of the tube, which allows fluid such as refrigerant to flow from inlet ports of channels at the first end to the outlet ports of the channels at the second end of the tube 206.

Tubes 206 are preferentially made of a lightweight, thermally conductive, and chemical-resistant material, however, the tube 206 may also be made of other materials as well, which are within the scope of this invention. In some embodiments, tube 206 may be made of aluminum extrusions. The tubes 206 are shown in drawings hereof, for ease and clarity of illustration, as having a fixed number of channels defining flow paths having a square cross-section. However, it is to be understood that in commercial applications, such as for example refrigerant vapor compression systems, each multichannel tube 206 may typically have about ten to twenty flow channels, but may have a greater or a lesser multiplicity of channels, as desired.

The first end of the tube 206 is adapted to be disposed within the inlet manifold 202 of the heat exchanger 200 using the brazing technique, 3-D printing technique, and other known techniques known in the art, such that the tube 206 remains inclined at a predefined angle from a horizontal planar axis of the manifold 202, with a certain section of the tube near the first end of the tube disposed within the inlet manifold 202 and rest section of the tube 100 protruding out of the inlet manifold 202 in the downward direction. Also, tube 206 is disposed within the manifold such that the flat wall or opposite walls of the tube orients perpendicular to a longitudinal axis of the inlet manifold 202 in the direction of the fluid coming out from the nozzle within the manifold 202.

The manifolds 202, 204 are preferably made up of cylindrical, aluminum tubing/housing having aluminum braze cladding on its exterior surface, however, the manifolds may also have a square, rectangular, hexagonal, octagonal, or other polygonal cross-section. On their facing sides, the manifolds 202, 204 are provided with a series of generally parallel slots or openings for the receipt of the corresponding first ends of the tubes 206, such that a first end or a section of the tubes 206 remain within the manifolds 202, 204. The tubes 206 are preferably formed of aluminum extrusions. The manifolds 202, 204 are preferably welded or brazed with the tubes 206. The slots are punched in the sides of the manifolds 202, 204. Further, each of the manifolds 202, 204 is provided with substantially spherical domes to improve the pressure resistance of the manifolds. The manifold has opposite ends closed by caps brazed or welded thereto. In the preferred embodiment, the various components are all brazed together, and accordingly, in the usual case, brazing is employed to fasten the caps on opposite ends of the manifold.

In an embodiment, a slot based on diameter of the supply tube 110 is punched at one end of the inlet manifold 202 and the supply tube 110 is inserted within the inlet manifold 202 followed by brazing the supply tube 110 with the inlet manifold 202. The nozzle 100 is fitted at the outlet of the supply tube 110 within the inlet manifold 202 and the ends of the inlet manifold 202 are closed by caps using brazing or welding technique to provide a leak-proof design. The supply tube 110 fitted with the nozzle 100, is disposed within the inlet manifold 202 such that the second end or second opening 108 of the nozzle 100 remains at least partially before the tubes 206 and the nozzle 100 remains at a predefined height above the first end (top end) of the tubes 206. In another embodiment, the supply tube 110 may also be attached or disposed within the inlet manifold 202 using 3-D printing techniques, and other known techniques known in the art.

Further, the heat exchanger 200 includes heat dissipating fins 214 of brazed clad aluminum extending parallelly between adjacent tubes 206. The fins 214 facilitate the exchange of heat between the fluid flowing through the tubes 206 and air flowing across the tubes 206 of the heat exchanger 200. Besides, the fins 214 also provide structural support and rigidity to the tubes 206 as well as the heat exchanger 200.

In some embodiments, as shown in FIG. 2, the heat exchanger 200 is a V-coil arrangement heat exchanger 200 having the inlet manifold 202 and the outlet manifold 204 oriented horizontally in the same plane over the support structure 212. Further, tubes 206 protrude from the inlet manifold 202 making an acute angle from the plane of the inlet manifold 202 in a downward direction and further extending in an upward direction at the same acute angle into the outlet manifold 204, such that the V-coil arrangement of the tubes 206 having a bend at bottom mid-point of the tubes 206 is formed. The bend at the bottom of tubes 206 results in the formation of an apex at the approximate midpoint of the V-shaped tubes 206. The apex is below the plane defined by the manifolds. Further, a condensate trough 208 is attached along the apex or bend of the tubes 206 by fasteners, extending along an axis parallel to the longitudinal axis of the manifolds 202, 204. Trough 208 is configured to collect condensate formed in the tubes 206 and the V-coil arrangement facilitates an easier flow of condensate towards the bottom trough 208. The trough 208 may be further provided with one or more condensate outlet fittings 216 to remove the collected condensate.

During operation, heat exchanger 200 receives cold two-phase mixture from the expansion device through a refrigerant line into the inlet manifold 202 of the heat exchanger 200 via the supply tube 110 and the distributor/nozzle 100. As the flow area of the nozzle 100 reduces in a direction from the first portion 102 to the second portion 104 of the nozzle 100, the velocity of mixture increases while flowing through the nozzle 100, which helps in breaking the liquid jet or jets into droplets much earlier leading to homogeneous two-phase flow and good distribution. In addition, the flat profile of the second portion 104 of the nozzle 100 generates a wider jet of the vapor within the inlet manifold 202 which nearly covers the entire diameter of the inlet manifold 202, thereby enhancing port-to-port distribution in the tubes 206. This increases the thermal capacity of the heat exchanger 200 compared to existing heat exchangers.

Further, the cold two-phase mixture within the inlet manifold 202 passes through the tubes 206 of the heat exchanger 200 where the two-phase mixture gets heated as it passes in a heat exchange relationship with an ambient air which is passed over the by a fan (not shown) that may be configured over top of the heat exchanger 200. The superheated vapor collects in the outlet manifold 204 of heat exchanger 200 and goes to the compressor and the cycle is completed. Further, the condensate from the condenser comes and expands to a low-pressure two-phase mixture in an expansion device 210.

It should be obvious to a person skilled in the art that while FIG. 2 and some embodiments of this invention have been elaborated for the V-coil arrangement heat exchanger for the sake of simplicity and better explanation purpose, however, the teachings of this invention are equally applicable for other heat exchanger having downward fluid flow configuration such as N-coil heat exchanger, J-coil heat exchanger, U-coil heat exchanger, and the like, and all such embodiments are well within the scope of this invention.

Thus, this invention (nozzle or distributor) overcomes the drawbacks, limitations, and shortcomings associated with existing technologies by providing a simple and efficient nozzle that enables even distribution of fluid or refrigerant across ports of the tubes within the inlet manifold of heat exchanger, with minimal pressure drop.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A distributor for an inlet manifold of a microchannel heat exchanger, the distributor comprising:

a nozzle adapted to be fluidically connected to an output of a supply tube of a refrigeration line of the heat exchanger within an inlet manifold of the heat exchanger, wherein the supply tube is at least partially disposed within the inlet manifold of the heat exchanger, the nozzle comprising:

a first hollow portion having a round cross-section and adapted to be fluidically connected to the supply tube within the inlet manifold; and a second hollow portion having an oval or elliptical cross-section, wherein the second hollow portion is fluidically connected to the first hollow portion such that the nozzle gradually transitions from the first hollow portion to the second hollow portion within the inlet manifold and flow area of the nozzle reduces in a direction from the first hollow portion to the second hollow portion.

2. The distributor of claim 1, wherein a first end of the nozzle comprises a first opening that is connected to the supply tube and a second end of the nozzle comprises a second opening opposite to the first opening.

3. The distributor of claim 2, wherein the second end of the nozzle is located at a distance relative to a first microchannel tube of a plurality of microchannel tubes of the heat exchanger along a longitudinal axis of the inlet manifold.

4. The distributor of claim 1, wherein the nozzle is at a predefined height above ports associated with one or more microchannel tubes associated with the inlet manifold.

5. The distributor of claim 1, wherein the first hollow portion of the nozzle has a predefined inner diameter equal to an inner diameter of the supply tube, and wherein the second hollow portion has a predefined height less than the inner diameter of the first hollow portion and a predefined width greater than the inner diameter of the first hollow portion.

6. The distributor of claim 1, wherein the second hollow portion has a predefined width to height ratio ranging from 40 to 1/40.

7. The distributor of claim 1, wherein the second hollow portion is oriented at a predefined angle within respect to a horizontal plane of the inlet manifold.

8. The distributor of claim 1, wherein the second hollow portion is oriented horizontally within the inlet manifold.

9. The distributor of claim 1, wherein the flow area of the nozzle from the first hollow portion to the second hollow portion is reduced in a range of 20-70%.

10. The distributor of claim 1, wherein a velocity of fluid, flowing through the nozzle, increases gradually from the first hollow portion to the second hollow portion.

11. A heat exchanger comprising:

an inlet manifold fluidically connected to an outlet manifold via a plurality of microchannel tubes;

a supply tube associated with a refrigeration line at least partially disposed within the inlet manifold; and a nozzle fluidically connected to an output of the supply tube within the inlet manifold, the nozzle comprising:

a first hollow portion having a round cross-section and adapted to be fluidically connected to the supply tube within the inlet manifold; and a second hollow portion having an oval or elliptical cross-section, wherein the second hollow portion is fluidically connected to the first hollow portion such that the nozzle gradually transitions from the first hollow portion to the second hollow portion within the inlet manifold and flow area of the nozzle reduces in a direction from the first hollow portion to the second hollow portion.

12. The heat exchanger of claim 11, wherein a first end of the nozzle comprises a first opening that is connected to the supply tube and a second end of the nozzle comprises a second opening opposite to the first opening.

13. The heat exchanger of claim 12, wherein the second end of the nozzle is located at a distance relative to a first microchannel tube of the plurality of microchannel tubes of the heat exchanger along a longitudinal axis of the inlet manifold.

14. The heat exchanger of claim 11, wherein the nozzle is at a predefined height above ports associated with the microchannel tubes withing the inlet manifold.

15. The heat exchanger of claim 11, wherein the first hollow portion of the nozzle has a predefined inner diameter equal to an inner diameter of the supply tube, and wherein the second hollow portion has a predefined height less than the inner diameter of the first hollow portion and a predefined width greater than the inner diameter of the first hollow portion.

16. The distributor of claim 11, wherein the second hollow portion has a predefined width to height ratio ranging from 40 to 1/40.

17. The heat exchanger of claim 11, wherein the second hollow portion is oriented at a predefined angle within respect to a horizontal plane of the inlet manifold.

18. The heat exchanger of claim 11, wherein the flow area of the nozzle from the first hollow portion to the second hollow portion is reduced in a range of 20-70%.

19. The heat exchanger of claim 11, wherein the supply tube is disposed of at one end of the inlet manifold, and wherein the supply tube is configured to supply a fluid from the refrigeration line within the inlet manifold via the nozzle to enable uniform distribution of the fluid across ports of each of the multichannel tubes within the inlet manifold.

* * * * *